US005542231A

United States Patent [19]

Ungar et al.

[11] Patent Number: 5,542,231

[45] Date of Patent: Aug. 6, 1996

[54] APPARATUS FOR ADAPTING CARRIER STOCK-APPLYING MACHINE TO APPLY CARRIER STOCK HAVING CONTAINER-ENGAGING AND HANDLE PORTIONS.

[75] Inventors: Robert E. Ungar, DesPlaines; Stanley R. Krogman, Bartlett, both of Ill.

[73] Assignee: Illinois Tool Works Inc., Glenview, Ill.

[21] Appl. No.: 518,202

[22] Filed: Aug. 23, 1995

[51] Int. Cl.[6] ..... B65B 27/04; B65B 61/14

[52] U.S. Cl. ..... 53/48.4; 53/134.1

[58] Field of Search ..... 53/398, 413, 48.3, 53/48.4, 134.1, 441, 556

[56] References Cited

U.S. PATENT DOCUMENTS

| | | | |
|---|---|---|---|
| 2,603,923 | 7/1952 | Chidsey, Jr. | 53/413 X |
| 2,874,835 | 2/1959 | Poupitch | 53/48.4 X |
| 3,046,711 | 7/1962 | Harrison | 53/413 X |
| 3,107,465 | 10/1963 | Cote | 53/413 X |
| 3,307,321 | 3/1967 | Beart | 53/48.3 X |
| 3,826,060 | 7/1974 | Vergobbi | 53/48.4 |
| 3,991,640 | 11/1976 | Schlueter | 53/48.4 X |
| 4,250,682 | 2/1981 | Braun | 53/48 |
| 4,817,361 | 4/1989 | Cunningham | 53/48.4 |
| 5,282,348 | 2/1994 | Dampier et al. | 53/413 X |

*Primary Examiner*—Horace M. Culver

*Attorney, Agent, or Firm*—Dressler, Goldsmith, Shore & Milnamow, Ltd.

[57] ABSTRACT

An apparatus is disclosed for adapting a machine employing a wheel assembly to apply a carrier stock to two rows of containers, such as beverage bottles, so that the machine can employ a carrier stock with each carrier having two container-engaging portions and a handle portion joined to the container-engaging portions at a longitudinally extending junction. A camming member for reconfiguring the carrier stock from a flattened condition into a reconfigured condition is positioned so that the carrier stock is drawn past the camming member before the carrier stock is received by the wheel assembly and is arranged to spread the container-engaging portions of the carriers laterally so that the handle portions of the carriers tend to be downwardly turned about the longitudinally extending junction of the carrier stock. Two pairs of spaced plates are provided for guiding the handle portion of each carrier of the carrier stock, as reconfigured from the flattened condition into the reconfigured condition, one such pair having an adjustable floor therebetween and guiding the handle portion thereof so that the carrier stock remains in the reconfigured condition when drawn onto the wheel assembly and the other pair guiding the handle portion thereof so that the carrier stock remains in the reconfigured condition when applied by the wheel assembly. A rotating wheel has arms for striking a frangible junction between the handle portion of each carrier and the handle portion of the following carrier of the series.

12 Claims, 4 Drawing Sheets

APPARATUS FOR ADAPTING CARRIER STOCK-APPLYING MACHINE TO APPLY CARRIER STOCK HAVING CONTAINER-ENGAGING AND HANDLE PORTIONS.

TECHNICAL FIELD OF THE INVENTION

This invention pertains to an apparatus for adapting a machine of a type employing a wheel assembly to draw a carrier stock onto rows of containers, such as beverage bottles or beverage cans, so that the machine can employ a carrier stock a type made from a resilient polymeric material, extending for an indefinite length, and comprising a series of carriers, each having two container-engaging portions and a handle portion joined to the container-engaging portions at a longitudinally extending junction. The carrier stock is provided to the machine in a flattened condition.

BACKGROUND OF THE INVENTION

As exemplified in U.S. Pat. No. 4,250,682, a machine of the type noted above employs a wheel assembly comprising a pair of spider wheels spaced from each other and rotatable about a horizontal axis, pairs of fixed jaw members spaced peripherally about one such wheel, pairs of movable jaw members spaced peripherally about the other wheel, and means including a cam and a follower for imparting a reciprocating movement to the movable jaw members relative to the fixed jaw members so as to stretch a carrier stock drawn onto the wheel assembly before the carrier stock is applied to two rows of the containers.

A carrier stock of the type noted above is disclosed in a copending, commonly owned United States patent application filed on Apr. 20, 1994, under Ser. No. 08/230,308.

A need has arisen, to which this invention is addressed, to adapt a machine of the type noted above so that the machine can apply a carrier stock of the type noted above to rows of containers, such as beverage bottles or beverage cans.

SUMMARY OF THE INVENTION

This invention provides an apparatus for adapting a machine of the type noted above so that the machine can apply a carrier stock of the type noted above.

As noted above, a carrier stock of the type noted above is made from a resilient polymeric material, such as low density polyethylene, extends for an indefinite length, and comprises a series of carriers. Each carrier has two container-engaging portions and a handle portion. The carrier stock is provided to the machine in a flattened condition, in which both of the container-engaging portions of each carrier extend laterally to the same side of a longitudinally extending junction with the handle portion of such carrier. Moreover, in the flattened condition, the handle portion of each carrier extends laterally to the opposite side of the longitudinally extending junction and is joined to the handle portion of the following carrier at a frangible junction. Typically, moreover, the handle portion of each carrier is joined to the handle portion of the following carrier of the series at a frangible junction.

According to a first aspect of this invention, the apparatus comprises means for reconfiguring the carrier stock from the flattened condition into a reconfigured condition. In the reconfigured condition, each of the container-engaging portions of each carrier extends laterally to a different side of the longitudinally extending junction with the handle portion of such carrier. Moreover, the handle portion of such carrier projects from the longitudinally extending junction generally at a right angle to the container-engaging portions of such carrier.

According to a second aspect of this invention, the apparatus comprises means for striking the carrier stock at the frangible junction between the handle portion of each carrier and the handle portion of the following carrier of the series, after the carrier stock has been applied by the wheel assembly, so as to separate the handle portion of each carrier from the handle portion of the following carrier of the series.

Preferably, the reconfiguring means comprises a camming member, which is positioned so that the carrier stock is drawn past the camming member before the carrier stock is received by the wheel assembly. The camming member is arranged to spread the container-engaging portions laterally so that the handle portions tend to be downwardly turned about the longitudinally extending junction.

Preferably, the apparatus further comprises means for guiding the handle portion of the carrier. Means may be thus provided for guiding the handle portion of each carrier of the carrier stock, as reconfigured from the flattened condition into the reconfigured condition, so that the carrier stock remains in the reconfigured condition when drawn onto the wheel assembly. Means may be also provided for guiding the handle portion of each carrier of the carrier stock, as reconfigured from the flattened condition into the reconfigured condition, so that the carrier stock remains in the reconfigured condition when applied by the wheel assembly.

In one contemplated arrangement of such guiding means, the apparatus further comprises two pairs of spaced plates. Thus, a first pair of spaced plates is arranged to guide the handle portion of each carrier of the carrier stock, as reconfigured from the flattened condition into the reconfigured condition, so that the carrier stock remains in the reconfigured condition when drawn onto the wheel assembly. Also, a second pair of spaced plates is arranged to guide the handle portion of each carrier of the carrier stock, as reconfigured from the flattened condition into the reconfigured condition, so that the carrier stock remains in the reconfigured condition when applied by the wheel assembly.

Preferably, in the foregoing arrangement, the apparatus further comprises means for limiting downward movement of the handle portion of each carrier of the carrier stock between the plates of the first pair so as to prevent downward movement thereof beyond a maximum depth. Preferably, moreover, the limiting means is adjustable so that the maximum depth is adjustable over a limited range of adjustments.

Preferably, the striking means comprises a wheel, means for rotating the wheel about an axis as the carrier stock applied to the containers by the wheel assembly is drawn past the wheel, and arms extending radially from the wheel, each arm being arranged to strike the carrier stock at the frangible junction between the handle portion of one carrier of the series and the handle portion of the following carrier of the series as the wheel is rotated and the carrier stock applied by the wheel assembly is drawn past the wheel.

These and other objects, features, and advantages of this invention are evident from the following description of a preferred embodiment of this invention with reference to the accompanying drawings.

DETAILED DESCRIPTION OF THE PREFERRED EMBODIMENT

Figure 1:
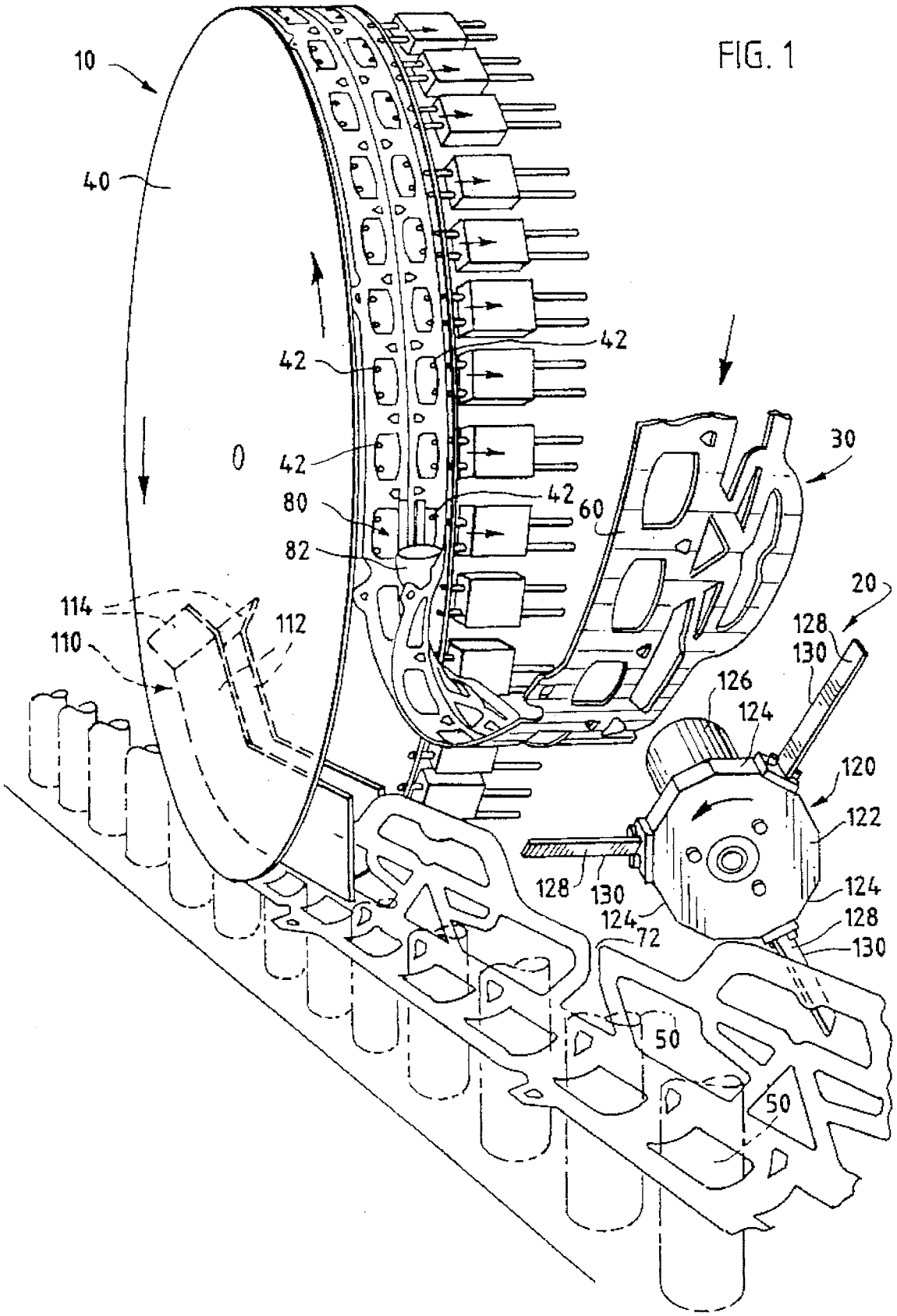
FIGS. 1 and 2 are schematic, perspective views taken from different vantages to illustrate a machine of the type noted above, as equipped with an apparatus constituting a preferred embodiment of this invention.
Figure 2:
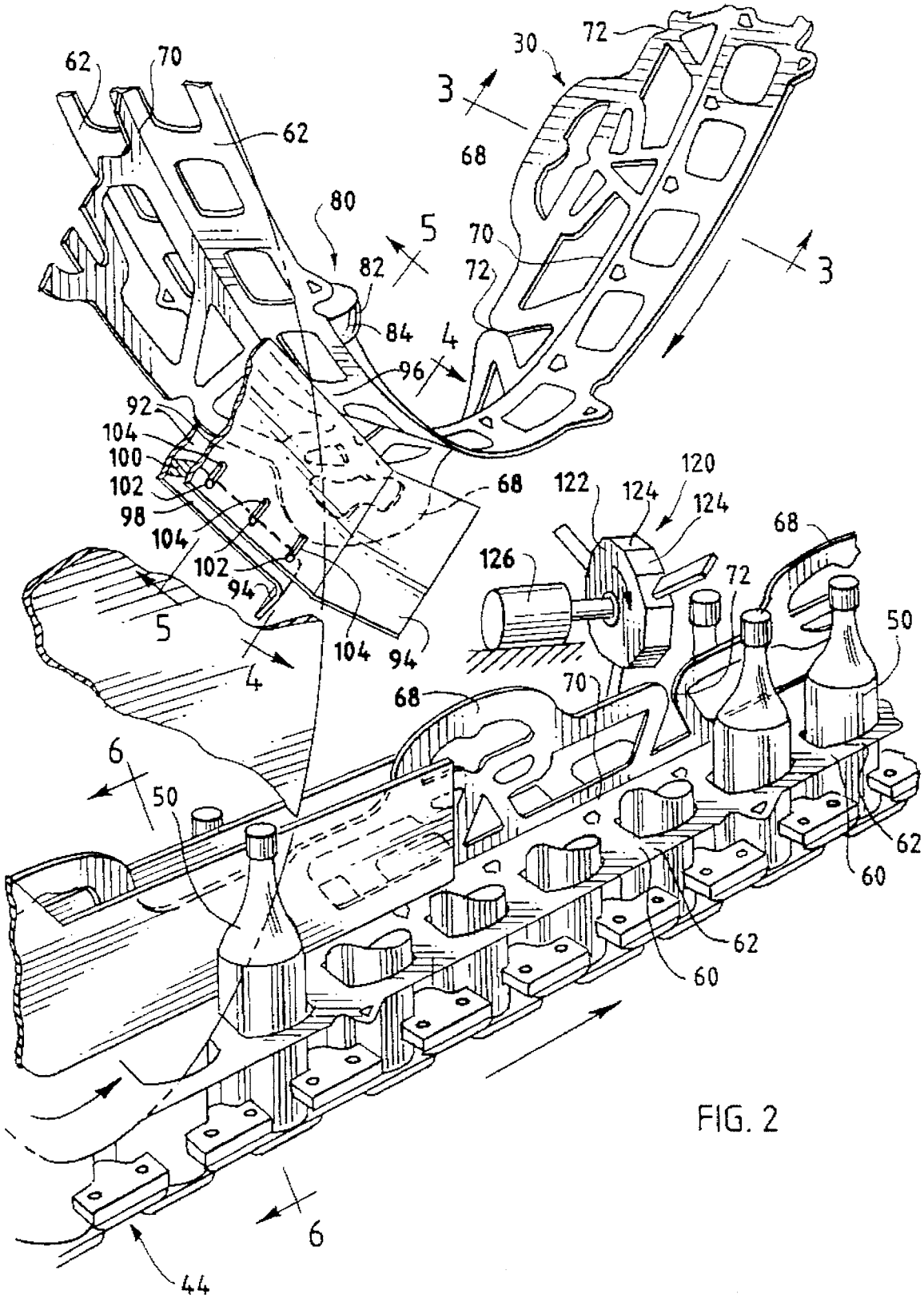

As illustrated in FIGS. 1 and 2, a machine 10 of the type noted above is equipped with an apparatus 20 constituting a preferred embodiment of this invention and adapting the machine 10 to apply a carrier stock 30 of the type noted above.

Being of the type noted above, the machine 10 employs a wheel assembly 40 to draw the carrier stock 30 onto two rows of containers 50, such as beverage bottles. The wheel assembly 40 includes a circumferential array of jaw sets 42, which include fixed jaw members and movable jaw members, which are arranged to stretch the carrier stock 30 laterally before the carrier stock 30 is applied to the containers 50. A conveyor 44 of a type known heretofore is provided for conveying the containers 50 into the machine 10, in two rows, and for conveying the containers 50 and the carrier stock 30 applied thereto from the machine 10.

Except as illustrated and described herein, the machine 10 and conveyor 44 are similar to the machine and conveyor illustrated and described in U.S. Pat. No. 4,250,682, the disclosure of which patent is incorporated herein by reference. Further information concerning a machine of the type noted above is found in U.S. Pat. No. 3,032,943, U.S. Pat. No. 3,032,944, U.S. Pat. No. 3,775,935, and U.S. Pat. No. 3,816,968, the disclosures of which patents also are incorporated herein by reference.

The carrier stock 30 is made from a resilient polymeric material, such as low density polyethylene, and is similar to the carrier stock illustrated and described in the copending, commonly owned U.S. patent application filed on Apr. 20, 1994, under Ser. No. 08/230,308, the disclosure of which application is incorporated herein by reference.

Figure 3:
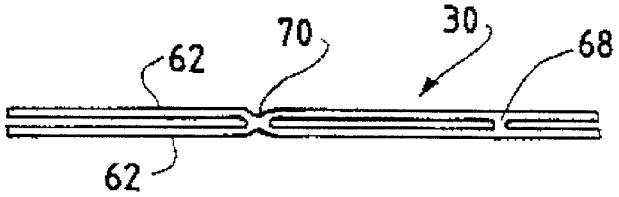
FIG. 3 is a sectional view taken along line 3—3 of FIG. 2, in a direction indicated by arrows, and showing a carrier stock of the type noted above, as provided in a flattened condition to the machine.
Figure 4:
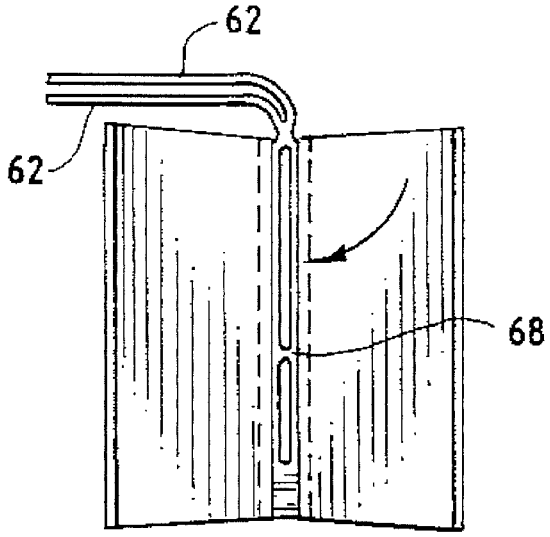
FIG. 4 is a sectional view taken along line 4—4 of FIG. 2, in a direction indicated by arrows, and showing the carrier stock, as guided at its handle portions by and between spaced plates of a first pair.
Figure 5:
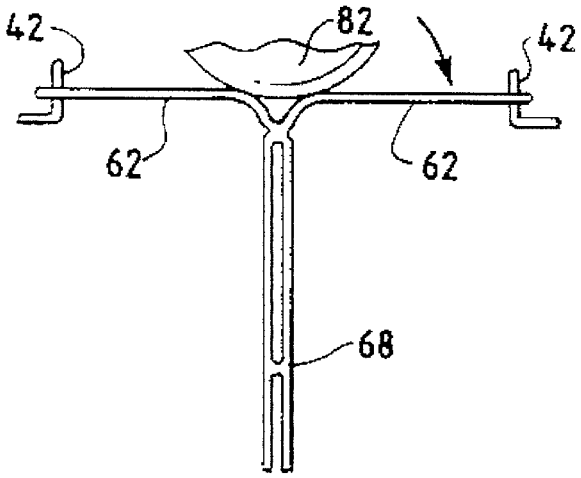
FIG. 5 is a sectional view taken along line 5—5 of FIG. 2, in a direction indicated by arrows, and showing the carrier stock, as spread at its container-engaging portions by a camming member.
Figure 6:
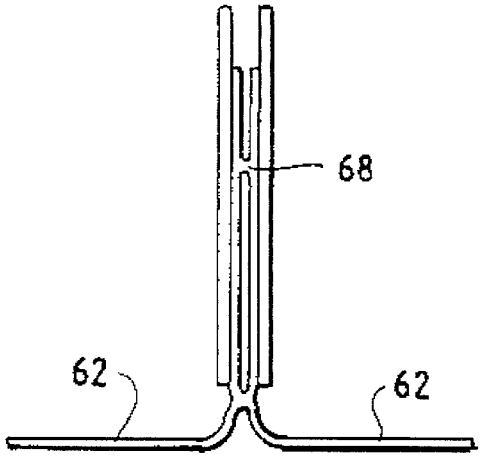
FIG. 6 is a sectional view taken along line 6—6 of FIG. 2, in a direction indicated by arrows, and showing the carrier stock, as guided at its handle portions by and between spaced plates of a second pair.

The carrier stock 30 comprises a series of substantially identical carriers 60. Each carrier 60 has two container-engaging portions 62, which include bands 64 defining container-receiving apertures 66, and a handle portion 68, which is joined to the container-engaging portions 62 at a longitudinally extending junction 70. The handle portion 68 of each carrier 60 is joined to the handle portion 68 of the next carrier of the series at a frangible junction 72, which is perforated, scored, or weakened otherwise, preferably perforated. As shown in FIG. 3, the carrier stock 30 is provided to the machine 10 in a flattened condition, in which both of the container-engaging portions 62 of each carrier 60 extend laterally to the same side of the longitudinally extending junction 70 and in which the handle portion 68 of each carrier 60 extends laterally to the opposite side of the longitudinally extending junction 70. The apparatus 10 comprises means 80 for reconfiguring the carrier stock 30 from the flattened condition into a reconfigured condition, in which each of the container-engaging portions 62 of each carrier 60 extends laterally to a different side of the longitudinally extending junction 70 and in which the handle portion 68 of such carrier 60 projects from the longitudinally extending junction generally at a right angle to the container-engaging portions 62 of such carrier 60.

As shown in FIGS. 1, 2, 5, 7, and 8, the reconfiguring means 80 comprises a camming member 82, which has a lower, hemispherical surface 84 and which is mounted to the machine 10 via brackets 86. The camming member 82 is positioned so that the carrier stock 30 is drawn beneath and past the lower, hemispherical surface 84 of the camming member 82 before the carrier stock 30 is received by the wheel assembly 40 and, more specifically, onto opposing jaws of the jaw sets 42. The camming member 82 is arranged to spread the container-engaging portions 62 of the carriers 60 laterally so that the handle portions 68 of the carriers 60 tend to be downwardly turned about the longitudinally extending junction 70 of the carrier stock 30. When the machine 10 is readied to apply a new supply of the carrier stock 30, a leading portion of the carrier stock 30 from the new supply is threaded manually beneath and past the lower, hemispherical surface 84 of the camming member 82, onto the wheel assembly 40. Subsequently, the carrier stock 30 tends to be self-threading beneath and past the lower, hemispherical surface 84 of the camming member 82 as the carrier stock 30 is drawn onto the wheel assembly 40 by the machine 10.

If the carrier stock 30 were not to remain in the reconfigured condition when drawn onto the wheel assembly 40 and when applied to the containers 50 by the wheel assembly 40, problems could arise. The handle portions 68 might interfere with the carrier stock 30 being applied. If the containers 50 were beverage bottles, as shown, some the handle portions 68 might be improperly applied around the necks of some of the bottles.

The apparatus 20 further comprises means 90 including a first pair of laterally spaced plates 92 for guiding the handle portion 68 of each carrier 60 of the carrier stock 30, as reconfigured from the flattened condition into the reconfigured condition, so that the carrier stock 30 remains in the reconfigured condition when drawn onto the wheel assembly 40. The plates 92 are mounted fixedly to the machine 10, in a generally tangential position relative to the wheel assembly 40, approximately where the carrier stock 30 is drawn onto the wheel assembly 40. The plates 92 are flared at the inlet ends 94 of the plates 92 so as to facilitate the handle portions 68 being drawn between the plates 92 as the carrier stock 30 is drawn onto the wheel assembly 40. Each of the plates 92 has a guiding edge 96, along which the container-engaging portions 62 are guided, and an opposite edge 98.

The guiding means 90 includes an adjustable member 100, which is mounted between the plates 92, near the latter edges 98 of the plates 92, via screws 102 passing through slots 104 in the plates 92. The member 100 limits movement of the handle portion 68 of each carrier 60 of the carrier stock 30 between the plates of the first pair in a direction in a direction generally at a right angle to the longitudinally extending junction 70 of the carrier stock 30 so as to prevent such movement beyond a maximum distance. Via the screws 102, the member 100 is adjustable so that the maximum distance is adjustable within a limited range of adjustments defined by the slots 104, so as to accommodate handle portions of different heights relative to the container-engaging portions. If the handle portions 68 were able to move too far in the direction noted above, some regions of the container-engaging portions 64 might be undesirably confined between the plates 92. If the handle portions 68 were not able to move far enough in the direction noted above, some regions of the handle portions 68 would tend undesirably to fold over the guiding edge 96 of one of the plates 92. The member 100 is adjusted accordingly.

Figure 7:
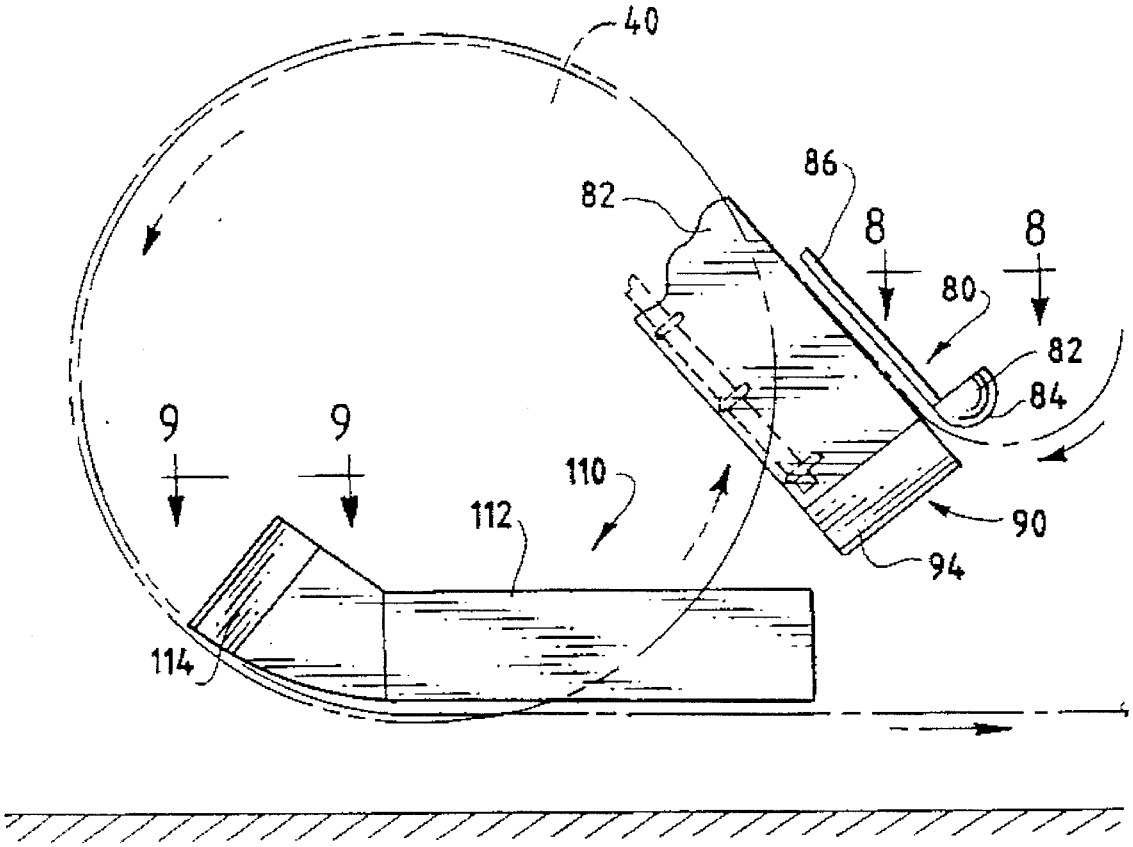
FIG. 7 is a schematic, elevational view showing a camming member and two pairs of laterally spaced plates, as included in the apparatus.
Figure 8:
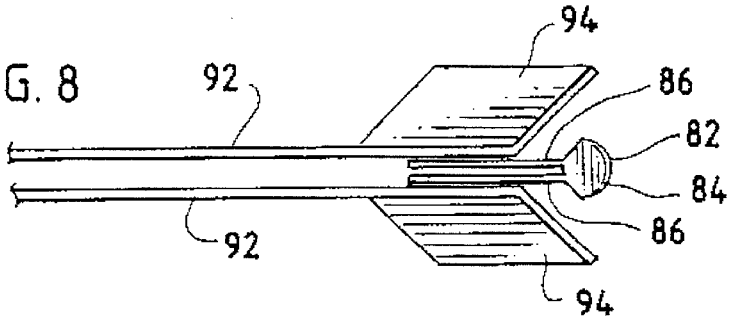
FIG. 8, on a larger scale, is a fragmentary view taken along line 8—8 of FIG. 7, in a direction indicated by arrows.
Figure 9:
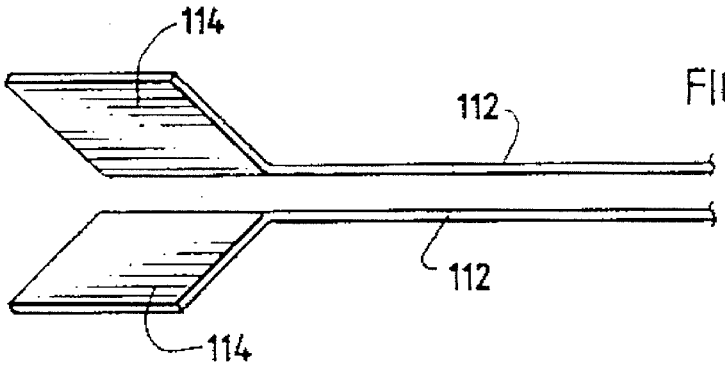
FIG. 9, on a similar scale, is a fragmentary view taken along line 9—9 of FIG. 7, in a direction indicated by arrows.

The apparatus 10 further includes means 110 including a second pair of spaced plates 112 having offset configurations, as shown in FIG. 7 and other views, for guiding the handle portion 68 of each carrier 60 of the carrier stock 30, as reconfigured from the flattened condition into the reconfigured condition, so that the carrier stock 30 remains in the reconfigured condition when applied by the wheel assembly 40 to the containers 50 and, more particularly, as the carrier stock 30 is removed from the jaw sets 42 onto the containers 50. The plates 102 are mounted fixedly to the machine 10, in a generally tangential position relative to a lower portion of the wheel assembly 40, approximately where the carrier stock 30 is applied to the containers 60 by the wheel assembly 40. The plates 102 are flared at their inlet end 114 so as to facilitate the handle portions 68 being drawn between the plates 112 as the carrier stock 30 is applied to the containers 50 by the wheel assembly 40.

After the carrier stock 30 has been applied to the containers 50, each applied carrier 60 is separated from the following carrier 60, at the container-engaging portions 62, via cutting mechanisms outside the scope of this invention. It is necessary, moreover, to separate each carrier 60 from the following carrier 60 at the frangible junction 72 between the handle portions 68 of the respective carriers 60.

The apparatus 20 comprises means 120 for striking the carrier stock 30 at the frangible junction 72 between the handle portion 68 of each carrier 60 and the handle portion 68 of the following carrier 60 of the series, after the carrier stock 30 has been applied to the containers 50 by the wheel assembly 40, so as to separate the handle portion 68 of each carrier 60 from the handle portion 68 of the following carrier 60 of the series. The striking means 120 comprises a polygonal wheel 122 having twelve facets 124, a motor 126 arranged for rotating the polygonal wheel 122 about a rotational axis as the carrier stock 30 applied by the wheel assembly 40 is drawn in a longitudinal direction past the polygonal wheel 122, and three arms 128 extending from selected facets 124 of the polygonal wheel 122, in regularly spaced, angular relation to one another.

Each arm 128 is shaped as a thin, dull blade having thin edges and flat faces, as shown in FIGS. 1 and 2, and is oriented at an acute angle relative to a radial plane, as if turned about a radial axis extending through such arm 128. The rotational axis, about which the polygonal wheel 122 is rotated, is oriented at an acute angle relative to the longitudinal direction, in which the carrier stock 30 applied by the wheel assembly 40 is drawn. Thus, each arm 128 is arranged to strike the carrier stock 30 along a leading edge 130 of such arm 128, at the frangible junction 72 between the handle portion 68 of one carrier 60 of the series and the handle portion 68 of the following carrier 60 of the series, as the polygonal wheel 122 is rotated and the containers 50 and the carrier stock 30 applied thereto are conveyed past the polygonal wheel 122 by the conveyor 44.

In alternative arrangements (not shown) which are suitable for larger or smaller containers and for carrier stock sized accordingly, the arms 128 are provided in a greater or lesser number, in each instance so as to extend from selected facets 124 of the polygonal wheel 122, in regularly spaced, angular relation to one another.

Various other modifications may be made in the preferred embodiment described above without departing from the scope and spirit of this invention.

We claim:

1. In a machine of a type employing a wheel assembly to draw a carrier stock onto rows of containers, an apparatus for adapting the machine so that the machine can apply a carrier stock of a type made from a resilient polymeric material, extending for an indefinite length, and comprising a series of carriers, each having two container-engaging portions and a handle portion joined to the container-engaging portions at a longitudinally extending junction of the carrier stock, the carrier stock being provided to the machine in a flattened condition, in which both of the container-engaging portions of each carrier extend laterally to the same side of the longitudinally extending junction of the carrier stock and in which the handle portion of each carrier extends laterally to the opposite side of the longitudinally extending junction, the apparatus comprising means for reconfiguring the carrier stock from the flattened condition into a reconfigured condition, in which each of the container-engaging portions of each carrier extends laterally to a different side of the longitudinally extending junction and in which the handle portion of said carrier projects from the longitudinally extending junction generally at a right angle to the container-engaging portions of said carrier.

2. The apparatus of claim 1 wherein the reconfiguring means comprises a camming member, which is positioned so that the carrier stock is drawn past the camming member before the carrier stock is received by the wheel assembly and which is arranged to spread the container-engaging portions of the carriers laterally so that the handle portions of the carriers tend to be downwardly turned about the longitudinally extending junction of the carrier stock.

3. The apparatus of claim 1 further comprising means for guiding the handle portion of each carrier of the carrier stock, as reconfigured from the flattened condition into the reconfigured condition, so that the carrier stock remains in the reconfigured condition when drawn onto the wheel assembly.

4. The apparatus of claim 1 further comprising means for guiding the handle portion of each carrier of the carrier stock, as reconfigured from the flattened condition into the reconfigured condition, so that the carrier stock remains in the reconfigured condition when applied by the wheel assembly.

5. The apparatus of claim 2 further comprising a first pair of spaced plates arranged to guide the handle portion of each carrier of the carrier stock, as reconfigured from the flattened condition into the reconfigured condition, so that the carrier stock remains in the reconfigured condition when drawn onto the wheel assembly and a second pair of spaced plates arranged to guide the handle portion of each carrier of the carrier stock, as reconfigured from the flattened condition into the reconfigured condition, so that the carrier stock remains in the reconfigured condition when applied by the wheel assembly.

6. The apparatus of claim 5 further comprising means for limiting movement of the handle portion of each carrier of the carrier stock between the plates of the first pair in a direction generally at a right angle to the longitudinally extending junction so as to prevent such movement beyond a maximum distance.

7. The apparatus of claim 6 wherein the limiting means is adjustable so that the maximum distance is adjustable over a limited range of adjustments.

8. In a machine of a type employing a wheel assembly to draw a carrier stock onto rows of containers, an apparatus for adapting the machine so that the machine can apply a carrier stock of a type made from a resilient polymeric material, extending for an indefinite length, and comprising a series of carriers, each having two container-engaging portions and a handle portion joined to the container-engaging portions at a longitudinally extending junction of the carrier stock, the carrier stock being provided to the machine in a flattened condition, in which both of the container-engaging portions of each carrier extend laterally to the same side of the longitudinally extending junction of the carrier stock, in which the handle portion of each carrier extends laterally to the opposite side of the longitudinally extending junction, and in which the handle portion of each carrier is joined to the handle portion of the following carrier at a frangible junction, the apparatus comprising means for striking the carrier stock at the frangible junction between the handle portion of each carrier and the handle portion of the following carrier of the series, after the carrier stock has been applied by the wheel assembly, so as to separate the handle portion of each carrier from the handle portion of the following carrier of the series.

9. The apparatus of claim 8 further comprising means including a camming member, which is positioned so that the carrier stock is drawn past the camming member before the carrier stock is received by the wheel assembly, for reconfiguring the carrier stock from the flattened condition into a reconfigured condition, in which each of the container-engaging portions of each carrier extends laterally to a different side of the longitudinally extending junction and in which the handle portion of said carrier projects from the longitudinally extending junction generally at a right angle to the container-engaging portions of said carrier.

10. The apparatus of claim 9 further comprising means including a first pair of spaced plates for guiding the handle portion of each carrier of the carrier stock, as reconfigured from the flattened condition into the reconfigured condition, so that the carrier stock remains in the reconfigured condition when drawn onto the wheel assembly, and means including a second pair of spaced plates for guiding the handle portion of each carrier of the carrier stock, as reconfigured from the flattened condition into the reconfigured condition, so that the carrier stock remains in the reconfigured condition when applied by the wheel assembly, and means for limiting movement of the handle portion of each carrier of the carrier stock between the plates of the first pair in a direction generally at a right angle to the longitudinally extending junction so as to prevent such movement thereof beyond a maximum distance.

11. The apparatus of claim 10 wherein the limiting means is adjustable so that the maximum distance is adjustable within a limited range of adjustments.

12. The apparatus of claim 8 wherein the striking means comprises a wheel, means for rotating the wheel about an axis as the carrier stock applied by the wheel assembly is drawn past the wheel, and arms extending radially from the wheel, each arm being arranged to strike the carrier stock at the frangible junction between the handle portion of one carrier of the series and the handle portion of the following carrier of the series as the wheel is rotated and the carrier stock applied by the wheel assembly is drawn past the wheel.

* * * * *